United States Patent [19]

Kröner

[11] Patent Number: 4,671,670

[45] Date of Patent: Jun. 9, 1987

[54] WRISTWATCH

[75] Inventor: Wolfgang Kröner, Pforzheim, Fed. Rep. of Germany

[73] Assignee: Pforzheimer Uhren-Rohwerke PORTA GmbH, Pforzheim, Fed. Rep. of Germany

[21] Appl. No.: 890,398

[22] Filed: Jul. 25, 1986

[30] Foreign Application Priority Data

Jul. 29, 1985 [DE] Fed. Rep. of Germany ..... 3527125

[51] Int. Cl.[4] ..... G04B 19/24

[52] U.S. Cl. ..... 368/37

[58] Field of Search ..... 368/28, 35–38; 74/63, 434, 437

[56] References Cited

U.S. PATENT DOCUMENTS 4,136,514 1/1979 Rochat ..... 368/28

4,271,493 6/1981 Tamaru et al. ..... 368/37

*Primary Examiner*—Vit M. Miska

[57] ABSTRACT

The operating mechanism for a watch indicating arrangement, especially for a date indicating structure of an electrically operated wristwatch provided with an indicating element which is advanced periodically and operated by a drive mechanism associated with the watch, the operating mechanism includes a non-uniform transmission gear structure with a driving and a driven gear which have at least one engagement mode in which the non-uniform rotational speed of the driven gear is relatively low while the available torque is relatively high and the driven gear has associated therewith means for engaging the indicating structure for advancing the indicating element a predetermined step with each revolution of the driven gear wherein the means for engaging the indicating element are so arranged that engagement of the indicating element for its advance takes place while the non-uniform transmission is in the highest torque providing engagement mode.

7 Claims, 10 Drawing Figures

WRISTWATCH

BACKGROUND OF THE INVENTION

The invention relates to a wristwatch, especially an electronically operated wristwatch which has indicating elements that are periodically operated.

Such a periodically operated indicating element which progresses only after certain periods of operation is, for example, a data indicator which has the days 1 to 31 marked on an indicating ring that is advanced by the watch operating mechanism daily, at midnight, ($0^{00}$ o'clock) by one step to the next day indication. In order to provide for such advancement within only a limited amount of time at $0^{00}$ o'clock, the indicating ring carrying the calender dates is usually equipped with a jump type advancing mechanism, for example, as described in German Utility Model DE-GM 1907388, which mechanism provides for the advance of the ring within a relatively short time.

However, the advancing of the indicator within a relatively short time requires a relatively large amount of energy which must be supplied by the watch's energy source, that is, generally from the spring of a spring motor or from a battery. In order to be able to supply the energy when needed the energy must be available over the full period of operation of a watch although it is needed only during a very short period once a day. If the stored energy, that is, the capacity of the energy storage, falls to the point that it can no longer provide the required energy burst, then operation of the watch is at its end. This disadvantage is particularly noticeable in connection with electric wristwatches which should be as small and light as possible and which should of course be operable for extended periods with the battery accommodated therein. The life of such a battery, however, is dependent not only on the battery design but it also depends on the load or respectively the load requirement for operating the watch drive mechanism. Not only the constant load requirements but also the maximum load requirements determine the life of such a battery. These batteries are generally designed specifically for wristwatches requiring a relatively low energy supply over very long periods of time. Peak power requirements as they occur, for example during date change operations, are highly disadvantageous for the life expectancy of such batteries. This is the main reason why light, elegant decorative watches of small volume which have only small batteries will generally be without date indication.

It is the object of the present invention to provide a mechanism for operating indicators which are activated only at certain points of time which require for the performance of a change of the indicator only a relatively small increase in maximum power to be provided by their power supply so that their maximum power requirements are only relatively little higher than the minimum or usual power requirements.

SUMMARY OF THE INVENTION

In order to keep the power requirements for power source of a wristwatch low during periodically required advancement actions, especially during the daily advance of a date indicating element which is operated by the drive mechanism for the watch, the advancement mechanism includes a non-uniform transmission gear structure with a driving and a driven gear which have at least one engagement mode in which the non-uniform rotational speed of the driven gear is relatively low while the available torque is relatively high and the driven gear has associated therewith means for engaging the indicating element a predetermined step with each revolution of the driven gear wherein the means for engaging the indicating element are so arranged that engagement of the indicating element for its advance takes place while the non-uniform transmission is in the highest torque providing mode in which the least amount of power is required for the operation.

Non-uniform drive transmissions are for example elliptical gears or gear arrangements with an eccentrically mounted circular gear in engagement with a non-circular or eccentrically mounted other gear. The driving gear is always operated by the watch drive mechanism or the periodically rotating drive at a given rotational speed while the driven gear is rotated at non-uniform rotational speed, that is, it executes non-uniform angles of rotation within a given time period since the transmission ratio changes with the angle of rotation between a high ratio providing a very low angular speed for the driven member and a low ratio providing a relatively high angular speed for the driven part. It is noted however that not only the rotational speed of the driven member is non-uniform but so is also the torque applied to the driven member which is reciprocal to its speed. The arrangement is then so selected that the highest torque is applied to the driven member just when the driven member is to operate the indicating changing mechanism. This arrangement insures that peak power requirements will not occur, that is, that the maximum power requirements are substantially reduced if the high-torque requiring indicating changing mechanism is operated during the appropriate constellation of the non-uniform transmission gear structure.

It is to be noted that, during most of the time of its operation, the mechanism for operating the date indicating ring requires practically no energy for its operation and it is during that time that the ring operating gear is at higher speed while for operation of the indicating ring the operating gear is in its low speed-high torque operating range.

However, instead of utilizing the highest torque for the operation of an indicator ring it may sometimes be desirable to actuate for example a control contact over a short period of time. If this is desired it is advantageous to utilize the gear's higher speed operating range since only little torque is required for this purpose and the operation should be performed in relatively little time and at a certain wiping speed to insure good contact. Snapping members which are often utilized in this connection are not required with such an arrangement.

The transmission ratio between the two non-uniform gears is generally 1 but it may be a multiple thereof. For the data indication drive, one would generally choose a transmission ratio of 1 with a rotational speed of one revolution a day. However, another rotational speed could be selected, especially if the drive is utilized for other applications. Particularly, common time units may be chosen such as one revolution per minute, hour, 12 hours, day, week, month or even year.

Since, generally, the non-uniform drive is arranged outside the main watch drive arrangement, that is, on the other side of the watch drive support plate, so that the gears of such a drive have to be removed before the watch drive mechanism can be serviced, means are provided for insuring proper engagement of the non-uniform gears: Preferably one of the non-uniform gears is provided with a tooth which projects further than any of the other teeth and the other gear has a radial recess at the appropriate location adapted to receive such projecting tooth of the first gear. Proper assembly of the drive is then easily possible.

SHORT DESCRIPTION OF THE DRAWINGS

DESCRIPTION OF THE PREFERRED EMBODIMENT

Figure 1:
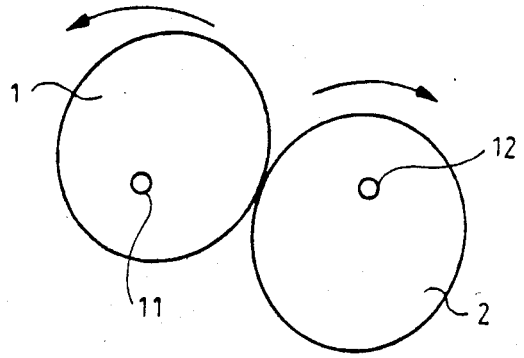
FIG. 1 shows two elliptical gears in engagement with one another.
Figure 2:
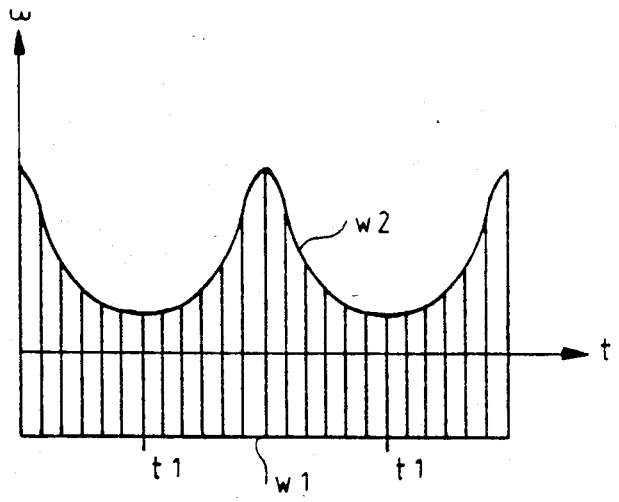
FIG. 2 shows curves representing the rotational speeds of the driving and the driven gears.

The driving gear 1 of a non-uniform transmission formed by two identical elliptical gears is shown in FIG. 1 in engagement with the driven gear 2. If the driving gear 1 is rotated by a watch's operating mechanism at a uniform speed, the driven gear 2 will have a rotational speed which varies as shown in FIG. 2. FIG. 2 shows the time on the X axis which is divided into equal lengths of time so that it is quite apparent that the non-uniform transmission converts the constant rotational velocity w1 of the driving gear 1 into the extremely non-uniform rotational velocity w2 of the driven gear 2.

Figure 3:
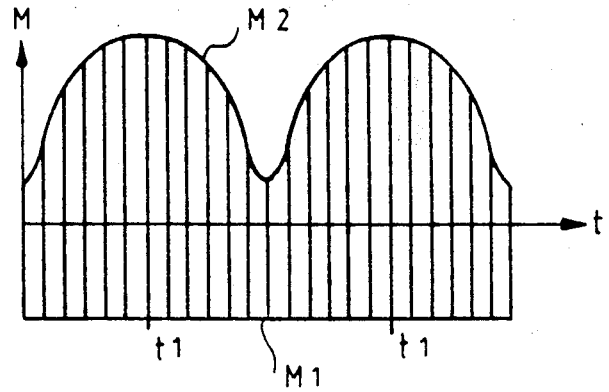
FIG. 3 shows the respective torques.

The curve showing the torque (FIG. 3) is correspondingly non-uniform. The uniform torque M1 is converted to the highly non-uniform torque M2. The rotational velocity and the torque variations are periodically repeated wherein the arrangement in a drive structure for the date indicating ring of a wristwatch, for example, may be so selected that the respective times t1 coincide with the time $0^{00}$ (midnight) which is the point at which the speed of the driven gear 2 is at the lowest value. At this point the torque available at the shaft of the driven gear 2 is at its highest value, that is, the lower power input is necessary the driving gear for the advancement of the date ring.

Figure 4:
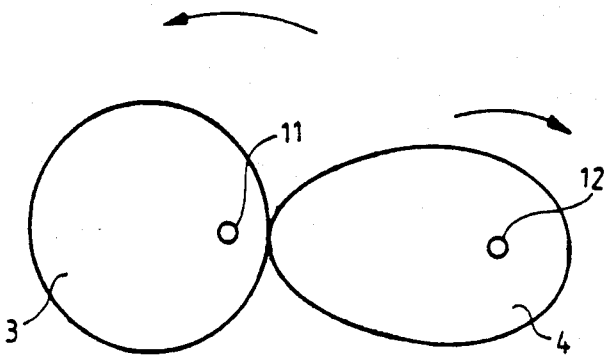
FIG. 4 shows a transmission with an eccentric circular gear and an appropriate oval gear.
Figure 5:
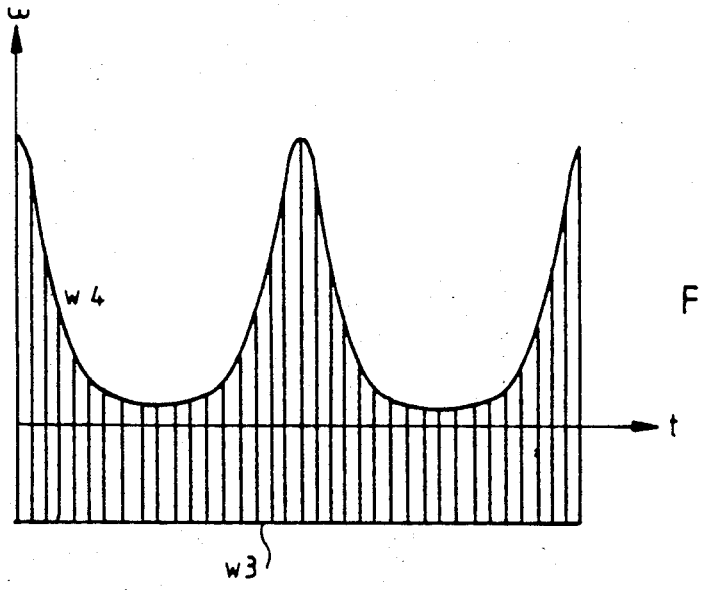
FIG. 5 shows curves representing the respective rotational speeds.
Figure 6:
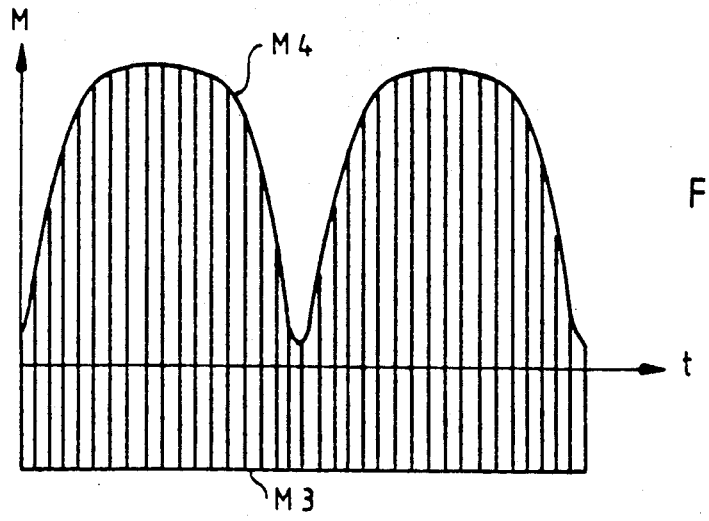
FIG. 6 shows a curve representing the torque of the transmission according to FIG. 4.

The gears 1 and 2 of the pair of gears of the non-uniform drive have shafts 11, 12 on which other gears are mounted. However, the driven gear 2 may also be directly provided with a projection adapted to engage the date ring for its advancement as shown later—FIG. 10. The same considerations apply to the non-uniform drive illustrated in FIGS. 4 to 6 wherein an eccentrically supported circular gear 3 is in engagement with an oval gear 4. This arrangement also provides for non-uniform rotational velocities w4 of the driven gear 4 on the basis of the uniform rotational velocity w3 of the driving gear 3 as shown in FIG. 5. This again results in uneven transmission torques as shown in FIG. 6 (torque M3 supplied to gear 3 results in torque M4 available at driven gear 4).

Figure 7:
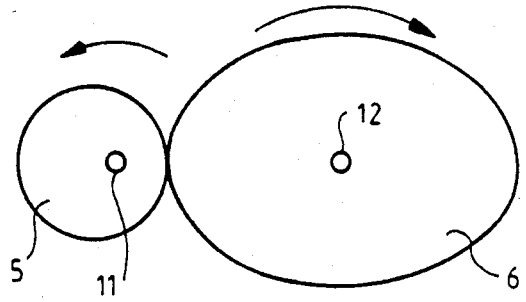
FIG. 7 shows a transmission with a transmission ratio of 2.
Figure 8:
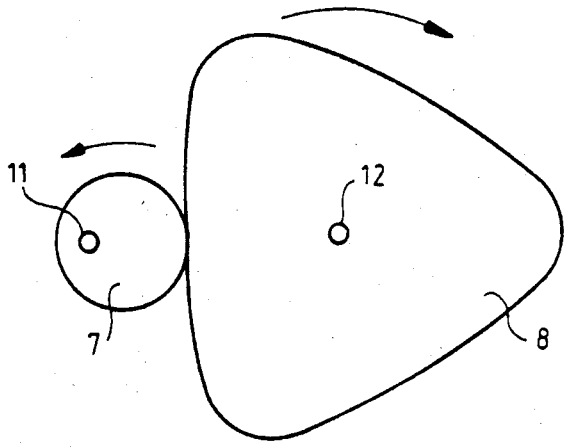
FIG. 8 shows a transmission with a transmission ratio of 3.

All the non-uniform transmissions referred to before have a transmission ratio of 1 wherein one revolution of the driving gear 1, 3 results in one revolution of the driven gear 2, 4. FIG. 7 shows a non-uniform transmission with a transmission ratio of 2 wherein the driving eccentrically supported circular gear 5 performs two revolutions for one revolution of the driven gear 6. Finally, FIG. 8 shows an arrangement with a transmission ratio of 3 wherein a driving eccentrically supported gear 7 is in engagement with a triangularly curved driven gear 8 and wherein the driving gear 7 performs three revolutions for every revolution of the driven gear 8.

Figure 9:
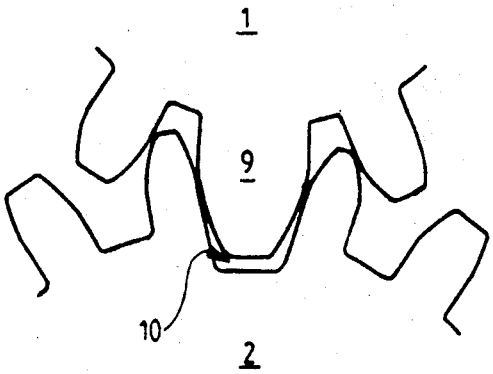
FIG. 9 shows a gear engaging arrangement with an enlarged indexing tooth and tooth receiving cavity.

FIG. 9 shows sections of a pair of gears wherein one gear, that is, for example, the driving gear 1, has a tooth 9 of increased length and the other gear, that is, the driven gear 2, has a corresponding increased recess 10 adapted to receive the tooth 9 of increased length if the transmission ratio is 1. For larger transmission ratios there are to be provided of course correspondingly more such recesses. Such a feature insures proper positioning of the gears 1, 2; 3, 4,; 5, 6 and 7, 8 and also facilitates the power assembly of the transmission.

Figure 10:
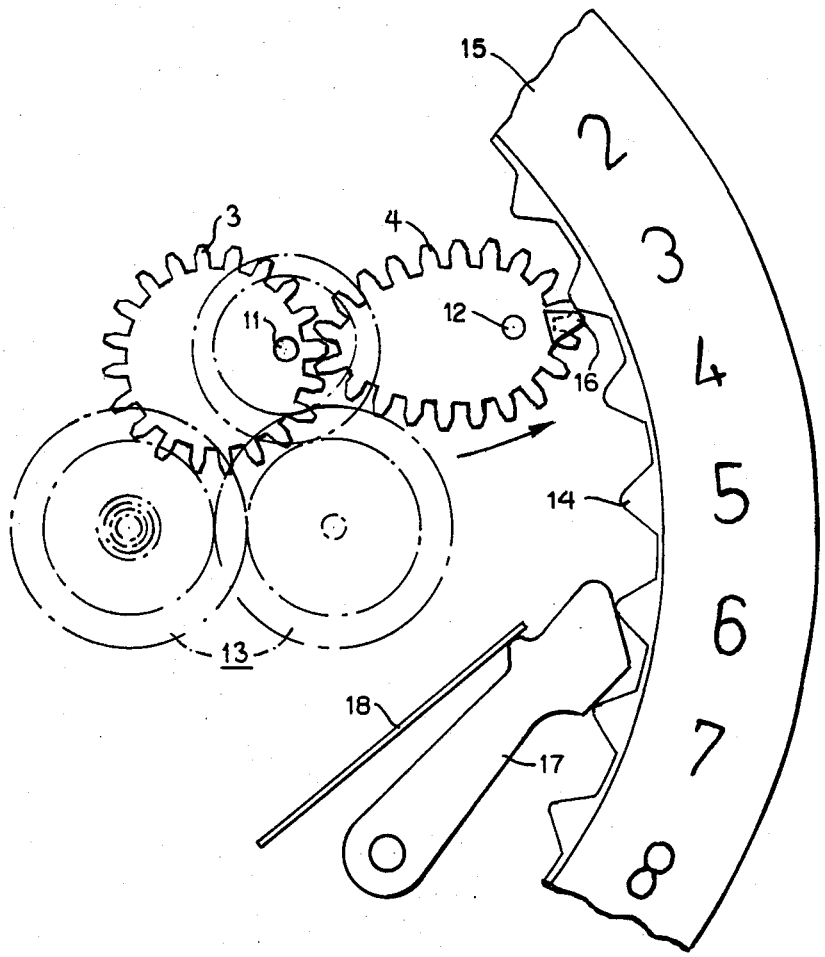
FIG. 10 shows the arrangement of a gear structure in a watch indicator drive mechanism.

FIG. 10 shows the arrangement of such a gear drive in a watch operating mechanism wherein the gear 3 mounted on the shaft 11 is so geared to the watch operating mechanism 13 that the shaft 11 and the eccentric gear 3 rotate at a speed of one revolution per day. As shown in FIG. 10 the oval gear 4 is in its highest torque providing angular position in which it is about to engage the gear structure 14 of a data ring 15 by means of a projection 16 mounted on the oval gear 4. There is also shown in FIG. 10 a retaining lever 17 biased in engagement with the gear structure 14 of the date ring 15 by a spring 18 in order to retain the date ring in the appropriate date indicating position when the date indicating ring is not engaged by the projection 16. When engaged by the projection 16 of the oval gear 4, the date indicator ring is carried along thereby camming and lifting the lever 17. As soon as the lever 17 rides over the camming tooth of the gear structure 14, the date indicating ring snaps forward to the next-day indicating position in which it remains engaged by the retaining lever.

What is claimed is:

1. An operating mechanism for a watch indicating arrangement, especially for a date indicating structure of an electrically operated wristwatch having an indicating element which is advanced periodically and operated by a drive mechanism associated with the watch, said operating mechanism including a non-uniform transmission gear structure with a driving and a driven gear having at least one engagement mode in which the non-uniform rotational speed of the driven gear is relatively low while the available torque is relatively high, said driven gear having associated therewith means for engaging said indicating structure for advancing said indicating structure a predetermined step with each revolution of the driven gear, said means for engaging said indicating structure being so arranged that engagement of said indicating structure takes place while said non-uniform transmission is in the extreme torque providing engagement mode.

2. A watch operating mechanism according to claim 1, wherein said non-uniform transmission gear structure includes eccentrically mounted elliptical gears.

3. A watch operating mechanism according to claim 1, wherein said non-uniform transmission includes an eccentrically mounted circular gear in engagement with an eccentrically mounted oval gear.

4. A watch operating mechanism according to claim 1, wherein the transmission ratio between said driving and said driven gear is one.

5. A watch operating mechanism according to claim 1, wherein the transmission ratio between said driving and said driven gear is a multiple of one.

6. A watch operating mechanism according to claim 4, wherein said driving gear of the non-uniform transmission is adapted to rotate once during a predetermined common time period (minute, hour, half-day, day, month, year).

7. A watch operating mechanism according to claim 1, wherein one of the pair of gears of said non-uniform gear transmission has one tooth of a height greater than that of the other teeth of the one gear and the other of the pair of gears has at the appropriate location a recess between two adjacent teeth which is larger than that between the others and adapted to receive said one tooth of greater height.

* * * * *